United States Patent [19]

Inukai et al.

[11] Patent Number: 4,799,135

[45] Date of Patent: Jan. 17, 1989

[54] HEADLIGHT FOR VEHICLE

[75] Inventors: Shinji Inukai; Nobuyoshi Kuno; Hiroyoshi Takanishi; Hiroki Sasaki, all of Yokohama, Japan

[73] Assignee: Kabushiki Kaisha Toshiba, Kawasaki, Japan

[21] Appl. No.: 920,063

[22] Filed: Oct. 17, 1986

[30] Foreign Application Priority Data

Oct. 18, 1985 [JP] Japan ..... 60-233073

[51] Int. Cl.[4] ..... F21V 7/00

[52] U.S. Cl. ..... 362/296; 362/310; 313/113; 313/620

[58] Field of Search ..... 362/310, 296, 61; 313/113, 620

[56] References Cited

U.S. PATENT DOCUMENTS

| | | | |
|---|---|---|---|
| 3,341,731 | 9/1967 | Wilson | 313/113 |
| 3,378,713 | 4/1968 | Ludwig | 313/113 |
| 3,862,449 | 1/1975 | Stuart et al. | 313/113 |
| 4,138,621 | 2/1979 | Downing et al. | 313/113 |
| 4,253,037 | 2/1981 | Driessen et al. | 313/620 |

*Primary Examiner*—James C. Yeung

*Attorney, Agent, or Firm*—Cushman, Darby & Cushman

[57] ABSTRACT

A headlight for a vehicle includes a metal halide lamp and a reflector having a focus and reflecting a light beam, emitted from the lamp, in a forward direction from the front of the vehicle. The lamp has a luminescent tube in which at least sodium is sealed, and positive and negative electrodes. The respective distal ends of the electrodes are located in the luminescent tube and spaced at a predetermined distance from each other. The lamp is positioned so that a straight line connecting the respective distal ends of the electrodes is horizontal and passes through the focus, and so as to meet the following requirement:

$$0 \leqq L0/L1 \leqq 0.4,$$

where L0 is the distance between the focus and the distal end of the negative electrode, and L1 is the distance between the distal ends of the electrodes.

6 Claims, 3 Drawing Sheets

HEADLIGHT FOR VEHICLE

BACKGROUND OF THE INVENTION

The present invention relates to a headlight for a vehicle, and more specifically, to a vehicle headlight using, as its light source, a miniature high-pressure metal-vapor discharge lamp with an output of 100 W or less, such as a metal halide lamp, high-pressure sodium lamp, etc.

Conventionally, incandescent lamps have been used as a light source of headlights for vehicles. However, they have some drawbacks, including low luminous efficiency, short life, and need of frequent replacement.

On the other hand, discharge lamps are generally known as a light source with high luminous efficiency and long life. For example, fluorescent lamps, low-pressure discharge lamps, are used for interior illumination in buses, streetcars, etc. However, they are too bulky to be used for the light source of headlights.

In these circumstances, use of high-pressure metal-vapor discharge lamps for the light source of headlights is being studied. The discharge lamps of this type, which include metal halide lamps, high-pressure sodium lamps, and the like, are higher in luminous efficiency than fluorescent lamps, and can be miniaturized with ease. When using these discharge lamps for headlights, a battery or direct-current power source of 12 or 14 V, carried in a vehicle, is used for the power supply. Thus, the discharge lamps can be miniaturized for an output of 100 W or less, and the operating system is based on either the direct-current operating process or the high-frequency operating process. If the high-frequency process is used in operating such a discharge lamp, especially a metal halide lamp, however, an unstable wavelength range is wide, due to the influence of the metal sealed in the lamps. Thus, acoustic resonance is produced, which will prevent stable operation, possibly causing the lamp to go out. Accordingly, the discharge lamps of this type must be operated by using the direct-current operating process, in which the power supply undergoes no change of polarity.

When operating the metal-vapor discharge lamps by the direct-current process, however, color separation is liable to be caused by cataphoresis. This tendency is expressly marked if sodium is sealed in a luminescent tube. This is because sodium is so light, in weight, that it is drawn up to the side of a negative electrode, which constitutes the coldest region of the lamp, thus making the vapor-pressure distribution in the tube uneven. In conventional headlights, light emitted from the light source is radiated forward by a reflector. The aforesaid color separation causes a difference in the tone of color, between the central and peripheral portions of a luminous distribution pattern of a light beam, radiated from the reflector.

In view of the requirements of the recent car design, moreover, the headlights are generally expected to be thinner, or reduced in the vertical dimension. Preferably, therefore, the high-pressure metal-vapor discharge lamps, for use as the light source, should be not only miniaturized, but also arranged so that positive and negative electrodes are arranged horizontally inside the reflector, thus assuming a so-called horizontal operating posture. Horizontal operating, however, is very liable to cause cataphoresis, thereby accelerating the color separation in the luminous distribution pattern of the light beam.

In general, a long-wavelength light (reddish light) is higher in linearity than a short-wavelength light (bluish light). Thus, if the light beam, radiated from the headlight, undergoes light separation so that a reddish tint is intensive at its peripheral portion, the beam will inevitably disturb drivers of cars coming in the opposite direction.

SUMMARY OF THE INVENTION

The present invention has been contrived in consideration of these circumstances, and its object is to provide a headlight for a vehicle, enjoying a satisfactory color distribution in a radiated beam, despite the use of a high-pressure metal-vapor discharge lamp as a light source, and capable of remote irradiation, without disturbing drivers of cars coming in the opposite direction.

In order to achieve the above object, according to the present invention, there is provided a headlight, in which a high-pressure metal-vapor discharge lamp includes positive and negative electrodes, spaced at distance L1 from each other, and a luminescent tube having a luminescence center halfway between the two electrodes, and in which the discharge lamp is positioned relatively to a reflector, so as to meet the following requirement:

$$0 \leqq L0/L1 \leqq 0.4,$$

where L0 is the distance between the focus of the reflector and the distal end of the negative electrode.

BRIEF DESCRIPTION OF THE DRAWINGS

FIGS. 1 to 5 show a headlight according to a first embodiment of the present invention, in which FIG. 1 is a sectional view of the headlight, FIG. 2 is a circuit diagram of an operating circuit for operating the headlight, FIG. 3 is a diagram showing the time-based change of voltage applied to a discharge lamp, FIG. 4 is a schematic view for illustrating the reflection characteristic of the headlight, and FIG. 5 is a diagram showing a luminous-intensity distribution pattern of the headlight.

DETAILED DESCRIPTION OF THE PREFERRED EMBODIMENTS

Preferred embodiments of the present invention will now be described in detail with reference to the accompanying drawings.

Figure 1:
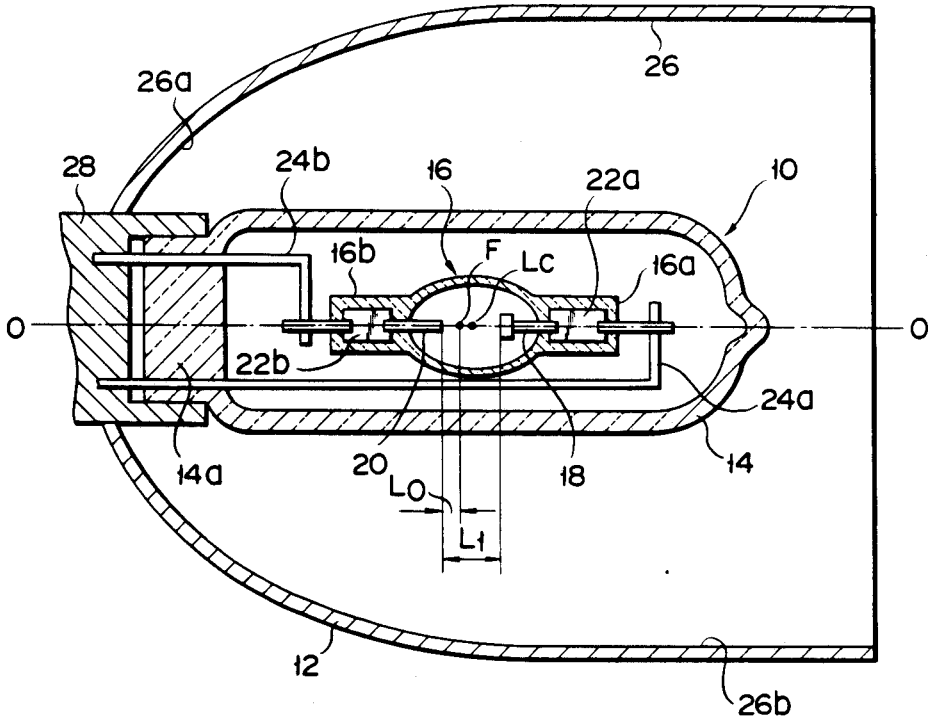

As shown in FIG. 1, a headlight according to a first embodiment of the invention comprises metal halide lamp 10 of 35-W output and reflector 12. Lamp 10 is operated by a direct-current power source, and reflector 12 serves to reflect light, emitted from the lamp, in a forward direction from the front of a vehicle.

Lamp 10 is provided with outer tube 14, which has sealed portion **14*a* at one end. The outer tube contains luminescent tube 16. Tube 16, which is formed from quartz glass, has a spherical, oval, or like shape. It includes a pair of sealed portions 16*a* and 16*b*. Rod-shaped positive and negative electrodes 18 and 20 are arranged coaxially in tube 16. The respective distal ends of the electrodes project toward the inner part of tube 16, so as to face each other at distance L1. The proximal end of positive electrode 18 is connected to lead wire 24a by means of molybdenum foil 22a, which is embedded in sealed portion 16a. The proximal end of negative electrode 20 is connected to lead wire 24b by means of molybdenum foil 22b, which is embedded in sealed portion 16b. Wires 24a and 24b penetrate sealed portion 14a of outer tube 14, and extend to the outside of the outer tube. A rare gas for starting, mercury, and scandium iodide and sodium iodide, as metal halogens, are sealed in luminescent tube 16. Luminescence center Lc of tube 16, constructed in this manner, is located halfway between the respective distal ends of electrodes 18 and 20**.

On the other hand, reflector 12 is formed from bright aluminum or the like, and has reflecting surface 26 which includes parabolic surface 26a of revolution and surface 26b continuous therewith and having a cross-section shaped like a running track. Paraboloid 26a has focus F, and surface 26 has optical axis O—O which passes through the focus. Socket 28 is mounted on the summit of paraboloid 26a.

Metal halide lamp 10 is attached to reflector 26 in a manner such that sealed portion 14a is fitted in socket 28. Optical axis O—O of reflector 12 is horizontal, and lamp 10 is positioned so that positive and negative electrodes 18 and 20 of luminescent tube 16 are located on axis O—O. Thus, lamp 10 is operated horizontally. Also, it is constructed so that electrodes 18 and 20 are located on the sides of a front opening of reflector 12 and socket 28, respectively. Moreover, lamp 10 is attached to reflector 12 in a manner such that focus F of reflector 12 is located between the distal end of negative electrode 20 and luminescence center Lc of tube 16. More specifically, lamp 10 is positioned so as to meet a requirement as follows:

$$0 \leqq L0/L1 \leqq 0.4, \quad (1)$$

where L0 is the distance between the distal end of electrode 20 and focus F.

An operating circuit for operating the headlight of the aforementioned construction will be described.

Figure 2:
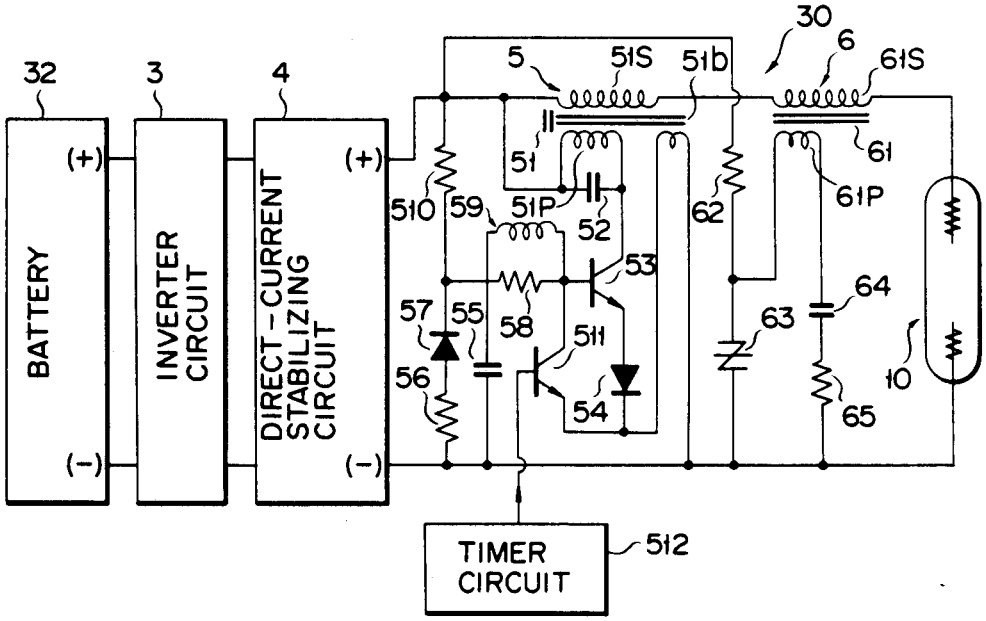

In operating circuit 30, as shown in FIG. 2, inverter circuit 3 is connected to the direct-current power source, i.e., battery 32 of a vehicle. Circuit 3 produces high frequency at high voltage. The output of circuit 3 is converted into a DC voltage by direct-current stabilizing circuit 4, which includes a rectifier, smoothing capacitor, ballast, etc. A positive output terminal of circuit 4 is connected to AC voltage generator circuit 5, including oscillation transformer 51 of a leakage type, and high-voltage pulse generator circuit 6, including pulse transformer 61. The output terminal is also connected to metal halide lamp 10, through secondary windings 51s and 61s of transformers 51 and 61, which are connected in series.

In AC voltage generator circuit 5, capacitor 52 is connected in parallel to primary winding 51p of oscillation transformer 51, thus constituting a resonance circuit. One end of the resonance circuit is connected to the positive output terminal of direct-current stabilizing circuit 4, while the other end is connected to a negative output terminal of circuit 4, through NPN switching transistor 53, diode 54, and base winding 51b of oscillation transformer 51, which are connected in series. The emitter of transistor 53 is connected to the base thereof by means of a series connection of two parallel circuits. One of the parallel circuits is formed of resistor 58 and coil 59, while the other includes a series connection of diode 54 and base winding 51b, and a parallel connection of capacitor 55 and a series circuit of resistor 56 and diode 57. The junction between the parallel circuit including capacitor 55, resistor 56, and diode 57, and the parallel circuit of resistor 58 and coil 59, is connected to the positive output terminal of circuit 4, via starting resistor 510. Npn control transistor 511 is connected between the base and emitter of transistor 53 via diode 54. Transistor 511 is designed so as to be turned on in a predetermined time after the power is switched on, that is, in some time after the start of arc discharge.

In high-voltage pulse generator circuit 6, a series circuit of resistor 62 and semiconductor switch 63, for use as a constant-voltage conductor element, is connected to the output terminals of direct-current stabilizing circuit 4. A series circuit of capacitor 64 and resistor 65 is connected in parallel with switch 63 through primary winding 61p of pulse transformer 61.

Figure 3:
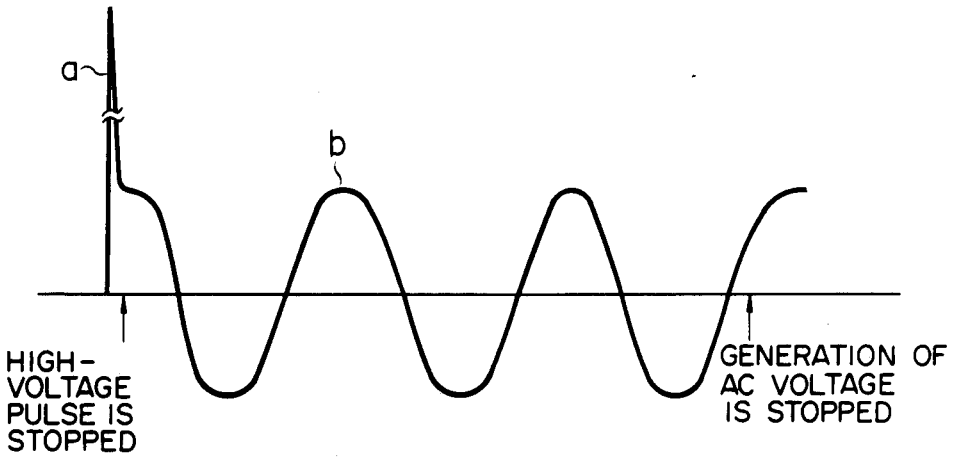

When an operating switch is turned on, in operating circuit 30 constructed in this manner, the DC voltage from direct-current stabilizing circuit 4 is applied to AC voltage generator circuit 5, high-voltage pulse generator circuit 6, and metal halide lamp 10. As a result, capacitor 64, in circuit 6, is charged. When the voltage of capacitor 64 reaches the level of the breakover voltage of semiconductor switch 63, the switch is turned on, so that capacitor 64 is discharged via primary winding 61p of pulse transformer 61, switch 63, and resistor 65. Thus, high-voltage pulses are produced in secondary winding 61s of transformer 61, and applied to lamp 10. In AC voltage generator circuit 5, switching transistor 53 is actuated to start oscillation, so that an AC voltage is produced in secondary winding 51s of oscillation transformer 51, and is applied to lamp 10. On receiving a high-voltage pulse, as indicated by symbol (a) in FIG. 3, lamp 10 undergoes dielectric breakdown, and proceeds to arc discharge. When the arc discharge occurs, the pressure between both electrodes of lamp 10 lowers, so that the switching operation of semiconductor switch 63 of generator circuit 6 stops, and the high-voltage pulses cease to be produced. As indicated by symbol (b) in FIG. 3, however, the AC voltage from circuit 5 continues to be applied to lamp 10. If the polarity of lamp 10 is inverted several times, or at least once, a cathode spot may possibly be formed on the proximal end of the negative electrode, in the initial stage. With the progress of the polarity inversion, however, the cathode spot comes to settle down at the distal end of the electrode or in the vicinity thereof. When the spot is fixed to the distal end of the electrode, control transistor 511 is turned on by timer circuit 512. As a result, switching transistor 53 is turned on compulsorily, so that the generation of the AC voltage from AC voltage generator circuit 5 is stopped. On and after this point of time, therefore, lamp 10 is maintained on, by a DC voltage from battery 32.

The operation of the headlight, with the aforementioned construction, will now be described.

When metal halide lamp 10 is operated by operating circuit 30, using battery 32 of the vehicle as a power source, vapors of mercury, scandium iodide, and sodium iodide are excited by direct-current discharge between positive and negative electrodes 18 and 20, so that luminescent tube 16 emits light. The light from tube 16 is reflected by reflecting surface 26 of reflector 12, and is radiated forwardly, as a light beam, from the front opening of the reflector.

Figure 4:
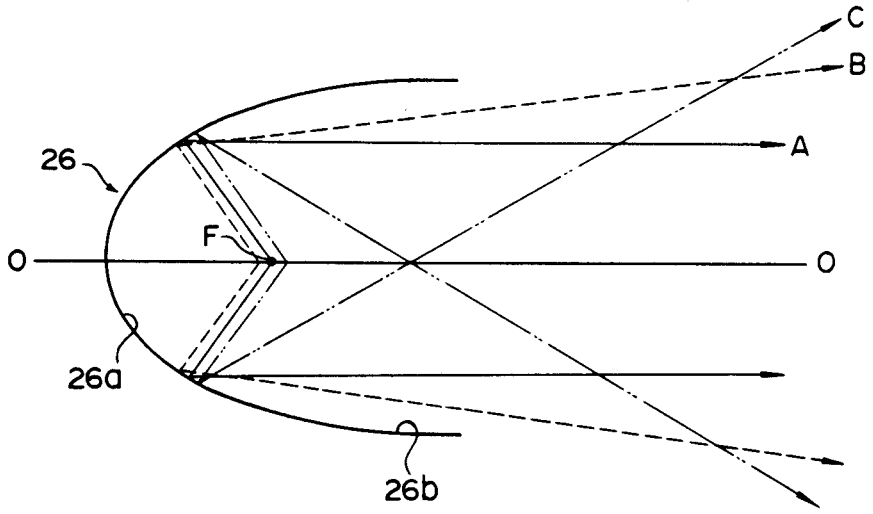
Figure 5:
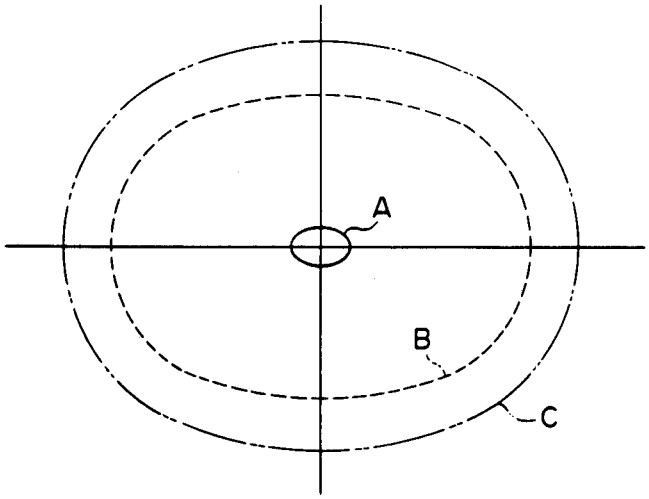

If reflecting surface 26 includes parabolic surface 26a of revolution, a light beam radiated from focus F is reflected by surface 26, thus being converted into a light beam parallel to optical axis O—O, as indicated by full-line arrow A in FIG. 4. A light beam radiated from a position on the side of the summit of paraboloid 26a, with respect to focus F, is reflected by surface 26 and diffuses, as indicated by broken-line arrow B. On the other hand, a light beam emitted from a position more distant from paraboloid 26a than focus F, is reflected by surface 26 and converges, as indicated by two dots and dash-line arrow C. As light beam C advances further, however, it crosses on optical axis O—O, and thereafter diffuses wider than light beam B. Thus, these three reflected light beams exhibit a luminous-intensity distribution as shown in FIG. 5. In the diagram of FIG. 5, the distribution is patterned by lines corresponding to the individual light beams shown in FIG. 4. The center spot portion corresponds to the parallel beam indicated by full-line arrow A; the intermediate spot portion to the reflected light beam indicated by broken-line arrow B, and the outermost spot portion to the beam indicated by two dots and dash-line arrow C.

In this embodiment, lamp 10 is operated horizontally by the direct-current power source, so that the light emitted from the lamp undergoes color separation, attributable to cataphoresis. In other words, sodium is drawn up to the side of negative electrode 20, so that the region near electrode 20 glows with a reddish tint. Such a phenomenon occurs also with luminescence of scandium.

According to the headlight of this embodiment, lamp 10 is arranged so that focus F of reflector 12 is located between luminescence center Lc of luminescent tube 16 and the distal end of negative electrode 20. Therefore, the reddish light is generated at the position corresponding to focus F, or at a position nearer to reflector 12 than the focus is. Accordingly, the light beam, reflected by reflector 12 and radiated ahead of the vehicle, exhibits a reddish tint in the center, and a bluish one at the peripheral portion. As mentioned before, moreover, a long-wavelength light (reddish light) is higher in linearity than a short-wavelength light (bluish light). Thus, if the central reddish glow of the light beam, radiated from the headlight, is intensive, the beam can easily reach a distant position. Also, the peripheral bluish tint provides a desired luminous-intensity distribution, which makes the light beam less dazzling to the eyes of drivers of cars running in the opposite direction. Moreover, the intensive reddish glow in the center improves the color-rendering properties of the beam.

Relation (1) was obtained as a result of an experiment conducted by the inventors hereof. In this experiment, a metal halide lamp of 35-W output, with interelectrode distance L1 of 5 mm, was disposed inside a reflector with a focal distance of 26 mm. Then, the state of luminescence of the lamp was observed. Thereupon, the reddish luminescent portion of the light beam, that is, the portion where sodium glows intensively, covered a distance of about 2 mm from the distal end of the negative electrode. In conclusion, it was indicated that the aforesaid function can be effected by locating focus F of the reflector between the distal end of the negative electrode, and the position at a distance of about 2 mm from the distal end, on the side of the positive electrode.

The range for the intensive luminescence of sodium depends on the size of the luminescent tube, especially on the interelectrode distance. The larger the tube, the wider the range will be. If the interelectrode distance and the distance from the distal end of the negative electrode to focus F are L1 and L0, respectively, we obtain $$0 \leqq L0/L1 \leqq 0.4.$$

Further experiments were conducted on luminescent tubes of different sizes and reflectors with different focal distances. Thereupon, satisfactory luminous-intensity distribution patterns were able to be obtained in cases where relation (1) was fulfilled. Thus, the propriety of relation (1) was substantiated.

According to the headlight constructed in this manner, even though the radiated light undergoes color separation, due to cataphoresis attributable to the horizontal operating, by means of the direct-current power source, the luminescence of sodium, near the negative electrode of the luminescent tube, takes place in the vicinity of the focus of the reflector. Therefore, the light beam from the headlight has a luminous-intensity distribution pattern, the central portion of which is tinged with red. Such a distribution pattern permits remote irradiation, without disturbing drivers of cars coming in the opposite direction. Thus, a proper luminous color distribution can be obtained by positively utilizing the color separation, which originally is an undesirable phenomenon.

Figure 6:
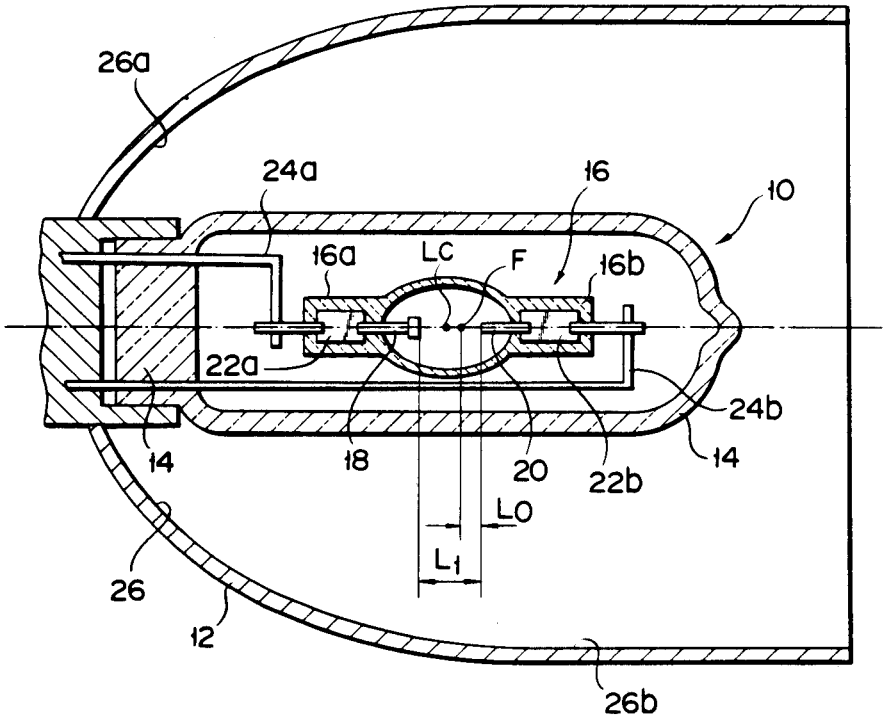
FIG. 6 is a sectional view of a headlight according to a second embodiment of the invention.

FIG. 6 shows a headlight according to a second embodiment of the present invention. In FIG. 6, like reference numerals refer to like portions as shown in FIG. 5, for simplicity. In the second embodiment, positive electrode 18 is located on the side of the summit of paraboloid 26a of revolution of reflector 12, while negative electrode 20 is located on the side of a front opening of the reflector. The headlight with such an arrangement can also provide the same functions or effects of the first embodiment, if metal halide lamp 10 and reflector 12 are disposed in a manner such that relation (1) is fulfilled.

It is to be understood that the present invention is not limited to the embodiments described above, and that various changes and modifications may be effected therein by one skilled in the art without departing from the scope or spirit of the invention. In the above embodiments, for example, a metal halide lamp is used as the light source. Alternatively, however, a high-pressure sodium lamp may be used for the purpose. According to the above embodiments, moreover, a straight line connecting the respective distal ends of the positive and negative electrodes is in alignment with optical axis O—O of the reflector. However, the headlight may be arranged so that the optical axis and the connecting line intersect each other, provided relation (1) is fulfilled.

What is claimed is:

1. A headlight for a vehicle adapted to be operated by a direct-current power source, comprising:

a high-pressure metal-vapor discharge lamp including a luminescent tube having at least sodium sealed therein as a luminescent metal, and including positive and negative electrodes having their respective distal ends spaced at a predetermined distance from each other and located in the luminescent tube; and a reflector having a focus and reflecting a light beam, emitted from the discharge lamp, in a forward direction from the front of the vehicle, said discharge lamp being positioned along a straight line connecting the respective distal ends of the positive and negative electrodes, said straight line being horizontal and passing through the focus, and said discharge lamp being arranged to fulfill the following requirement so that the luminescent region of reddish light radiated from said at least sodium is located at the same position as the focus:

$$0 \leqq L0/L1 \leqq 0.4,$$

where L0 is the distance between the focus and the distal end of the negative electrode, and L1 is the predetermined distance between the respective distal ends of the positive and negative electrodes;

said discharge lamp in cooperation with said reflector producing a light beam having a luminous distribution pattern with reddish light, radiation from said at least sodium, being located at a center thereof and light of other colors being located around the reddish light.

2. The headlight according to claim 1, wherein said reflector has a reflecting surface, including a parabolic surface of revolution, and an optical axis, passing through the focus and coaxial with the straight line connecting the respective distal ends of the positive and negative electrodes.

3. The headlight according to claim 1, wherein said high-pressure metal-vapor discharge lamp is a metal halide lamp.

4. The headlight according to claim 1, wherein said high-pressure metal-vapor discharge lamp is a high-pressure sodium lamp.

5. The headlight according to claim 1, wherein said reflector has a reflecting surface, including a parabolic surface of revolution, and a front opening facing the paraboloid, and said positive and negative electrodes are located on the sides of the opening and the summit of the paraboloid, respectively.

6. The headlight according to claim 1, wherein said reflector has a reflecting surface, including a parabolic surface of revolution, and a front opening facing the paraboloid, and said positive and negative electrodes are located on the sides of the summit of the paraboloid and the opening, respectively.

* * * * *